US009779658B2

(12) United States Patent
Kuo

(10) Patent No.: US 9,779,658 B2
(45) Date of Patent: Oct. 3, 2017

(54) PIXEL CIRCUIT, DISPLAY PANEL AND DISPLAY DEVICE COMPRISING THE PIXEL CIRCUIT

(71) Applicant: SHENZHEN CHINA STAR OPTOELECTRONICS TECHNOLOGY CO., LTD., Shenzhen (CN)

(72) Inventor: Ping Sheng Kuo, Shenzhen (CN)

(73) Assignee: SHENZHEN CHINA STAR OPTOELECTRONICS TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 14/416,874

(22) PCT Filed: Sep. 19, 2014

(86) PCT No.: PCT/CN2014/086894
§ 371 (c)(1),
(2) Date: Jun. 25, 2015

(87) PCT Pub. No.: WO2016/004679
PCT Pub. Date: Jan. 14, 2016

(65) Prior Publication Data

US 2017/0110052 A1 Apr. 20, 2017

(30) Foreign Application Priority Data

Jul. 7, 2014 (CN) ..... 2014 1 0321425

(51) Int. Cl.
*G09G 3/32* (2016.01)
*G09G 3/3233* (2016.01)
*G09G 3/3266* (2016.01)

(52) U.S. Cl.
CPC ..... *G09G 3/3233* (2013.01); *G09G 3/3266* (2013.01); *G09G 2300/0871* (2013.01);
(Continued)

(58) Field of Classification Search
CPC ..... G09G 3/3233; G09G 3/3266; G09G 2310/0289
See application file for complete search history.

(56) References Cited

U.S. PATENT DOCUMENTS 7,180,486 B2 2/2007 Jeong
7,283,108 B2 10/2007 Kasai
(Continued)

FOREIGN PATENT DOCUMENTS

CN 1503211 A 6/2004
CN 1744774 A 3/2006
(Continued)

OTHER PUBLICATIONS

Office Action issued on Oct. 10, 2015, by the State Intellectual Property Office of China in corresponding Chinese Patent Application No. 201410321425.2. (10 pages).
(Continued)

*Primary Examiner* — Ariel Balaoing
(74) *Attorney, Agent, or Firm* — Buchanan Ingersoll & Rooney PC

(57) ABSTRACT

The present disclosure discloses a pixel circuit, a display panel comprising the pixel circuit, and a display device comprising the pixel circuit. The pixel circuit comprises a first transistor, a second transistor, a third transistor, a fourth transistor, and a fifth transistor. The lifetime of the circuit can be prolonged by the pixel circuit with threshold voltage compensation function of the present disclosure. The pixel circuit can not only be used in large sized display device
(Continued)

driven through SE mode, but also be used in medium or small sized display device driven through PE mode.

4 Claims, 7 Drawing Sheets

(52) U.S. Cl.
CPC ..... *G09G 2310/0289* (2013.01); *G09G 2320/0233* (2013.01); *G09G 2320/0242* (2013.01)

(56) References Cited

U.S. PATENT DOCUMENTS

| | | | | |
|---|---|---|---|---|
| 7,329,849 | B2 | 2/2008 | Kasai | |
| 8,334,825 | B2 | 12/2012 | Kim | |
| 8,797,369 | B2 | 8/2014 | Choi | |
| 2004/0130513 | A1 | 7/2004 | Miyazawa | |
| 2004/0183758 | A1 | 9/2004 | Chen et al. | |
| 2005/0093464 | A1 | 5/2005 | Shin et al. | |
| 2007/0103406 | A1* | 5/2007 | Kim | G09G 3/3233 345/76 |
| 2007/0257868 | A1 | 11/2007 | Kasai | |
| 2007/0262931 | A1* | 11/2007 | Peng | G09G 3/3233 345/76 |
| 2008/0238892 | A1 | 10/2008 | Chiou | |
| 2010/0090993 | A1* | 4/2010 | Tseng | G09G 3/3233 345/204 |
| 2011/0074757 | A1* | 3/2011 | Chung | G09G 3/3233 345/211 |
| 2011/0090202 | A1 | 4/2011 | Han | |
| 2011/0157134 | A1 | 6/2011 | Ogura | |
| 2011/0227903 | A1* | 9/2011 | Choi | G09G 3/3233 345/212 |
| 2013/0093652 | A1* | 4/2013 | Kim | G09G 3/3233 345/77 |

FOREIGN PATENT DOCUMENTS

| | | | |
|---|---|---|---|
| CN | 1856195 | A | 11/2006 |
| CN | 101127189 | A | 2/2008 |
| CN | 101256732 | A | 9/2008 |
| CN | 101276545 | A | 10/2008 |
| CN | 201199736 | Y | 2/2009 |
| CN | 102467873 | A | 5/2012 |
| CN | 102708789 | A | 10/2012 |
| CN | 103440845 | A | 12/2013 |
| CN | 203325407 | U | 12/2013 |
| JP | 2004-198493 | A | 7/2004 |

OTHER PUBLICATIONS

International Search Report (PCT/ISA210) and Written Opinion (PCT/ISA/237) issued on Mar. 27, 2015, by the State Intellectual Property Office of China in corresponding International Application No. PCT/CN2014/086894. (10 pages)

* cited by examiner

PIXEL CIRCUIT, DISPLAY PANEL AND DISPLAY DEVICE COMPRISING THE PIXEL CIRCUIT

CROSS REFERENCE TO RELATED APPLICATION

The present application claims benefit of Chinese patent application CN 201410321425.2, entitled "Pixel Circuit, Display Panel and Display Device Comprising the Pixel Circuit" and filed on Jul. 7, 2014, which is incorporated herein by reference.

FIELD OF THE INVENTION

The present disclosure relates to the technical field of display device, and particularly relates to Active Matrix Organic Light Emitting Diode (AMOLED) display. Specifically, the present disclosure relates to a pixel circuit, a display panel comprising the pixel circuit, and a display device comprising the pixel circuit.

BACKGROUND OF THE INVENTION

After Thin Film Transistor-Liquid Crystal Display (TFT-LCD) emerges, the AMOLED display panel has become a new generation display panel with the most promising future. Compared with traditional liquid crystal display panel, the AMOLED panel has the advantages of thin, light, and simple structure, self-luminous without backlight, wide viewing angle, beautiful and colorful images, and bendable.

In general, each of the pixel circuits of the AMOLED panel is equipped with Low Temperature Poly-Si Thin Film Transistor (LT P—Si TFT) with switching function and a charge storage capacitor. In addition, the peripheral driving circuit and the display array of the AMOLED panel are integrated in the same glass substrate.

During the manufacturing of the AMOLED panel, laser scanning is widely used in the crystallization. Due to the instable power of the laser beam, the Thin Film Transistors formed in the scanning lines obtained by the scanning of the laser beam may have different threshold voltages, and thus the problem of non-uniform image qualities in a plurality of pixel regions could be caused.

FIG. 1 is a structural diagram of the pixel circuit 100 (with two transistors and one capacitor; 2T1C) in the current Organic Light Emitting Diode (OLED) display technology. The method for driving the pixel circuit 100 is as follows. When the scanning line SL receives the scanning signal Vscan and therefore the Thin Film Transistor T1 is turned on, the data line DL receives the data signal Vdata, so that the data signal Vdata is stored in the capacitor Cc through the Thin Film Transistor T1. When the scanning line SL receives the scanning signal Vscan and therefore the Thin Film Transistor T1 is turned off, the Thin Film Transistor T2 is turned on continuously, so that the voltage stored in the capacitor Cc is applied to the OLED of the pixel circuit. In this case, the driving current Ioled which drives the OLED to emit light can be generated.

However, in the above pixel circuit, since the Thin Film Transistor T2 is under the state of positive bias driving for a long time, the threshold voltage Vth of the Thin Film Transistor T2 would drift. Once the drifting of the threshold voltage Vth of the Thin Film Transistor T2 happens, the driving current Ioled flowing through the OLED would be affected directly. Consequently, for each pixel circuit in the OLED display technology, the currents flowing through the OLEDs of the respective pixel circuits and reflecting the same data signal Vdata would be different from one another. Under such circumstances, the gray-scales of the OLEDs of the respective pixel circuits would be different from one another, and thus the display uniformity of the OLED panel would be affected.

To solve the above problem, a pixel circuit having a structure of three transistors and one capacitor (3T1C) with compensation function is proposed in the prior art. However, the above pixel circuit having a 3T1C structure can only be used in large sized OLED display device driven through Simultaneous Emission (SE) mode, but cannot be used in OLED display device driven through Progressive Emission (PE) mode.

Therefore, how to solve the aforesaid problem has become an effort demanding task in the industry.

SUMMARY OF THE INVENTION

One of the technical problems to be solved by the present disclosure is to provide a pixel circuit, which can solve the problem of the drifting of the threshold voltage and thus prolong the lifetime of the circuit. Moreover, the pixel circuit can both be used in the OLED display device driven through PE mode, and be used in the OLED display device driven through SE mode.

To solve the aforesaid technical problem, the present disclosure provides a pixel circuit, comprising: a first transistor, wherein a gate thereof is used for receiving a scanning signal, a source thereof is used for receiving a data signal, and a drain thereof is connected to a first node; a second transistor, wherein a gate thereof is used for receiving said scanning signal, a source thereof is connected to a reference voltage, and a drain thereof is connected to a second node; a storage capacitor connected between said first node and said second node; a third transistor, wherein a gate thereof is connected to said second node, and a source thereof is connected to said first node; a fourth transistor, wherein a gate thereof is used for receiving a signal opposite to said scanning signal, a source thereof is connected to a first voltage, and a drain thereof is connected to said first node; a fifth transistor, wherein a gate thereof is used for receiving a light-emitting signal, and a source thereof is connected to the drain of said third transistor; and a light-emitting module, wherein an anode thereof is connected to the drain of said fifth transistor, and a cathode thereof is connected to a second voltage, said second voltage being lower than said first voltage.

In one embodiment, said first transistor, said second transistor, said third transistor, said fourth transistor, and said fifth transistor are all Positive channel Metal Oxide Semiconductor (PMOS) type thin film transistors, and said light-emitting module is organic light-emitting diode.

According to another aspect of the present disclosure, the present disclosure further provides a display panel, comprising: a plurality of data lines; a plurality of scanning lines, which are configured in an orthogonally staggered manner with respect to said data lines so as to form a plurality of pixel regions; and a plurality of pixel circuits configured in said pixel regions respectively, wherein each of said pixel circuits comprises: a first transistor, wherein a gate thereof is used for receiving a scanning signal, a source thereof is used for receiving a data signal, and a drain thereof is connected to a first node; a second transistor, wherein a gate thereof is used for receiving said scanning signal, a source thereof is connected to a reference voltage, and a drain thereof is connected to a second node; a storage capacitor connected between said first node and said second node; a third transistor, wherein a gate thereof is connected to said second node, and a source thereof is connected to said first node; a fourth transistor, wherein a gate thereof is used for receiving a signal opposite to said scanning signal, a source thereof is connected to a first voltage, and a drain thereof is connected to said first node; a fifth transistor, wherein a gate thereof is used for receiving a light-emitting signal, and a source thereof is connected to the drain of said third transistor; and a light-emitting module, wherein an anode thereof is connected to the drain of said fifth transistor, and a cathode thereof is connected to a second voltage, said second voltage being lower than said first voltage.

In one embodiment, said first transistor, said second transistor, said third transistor, said fourth transistor, and said fifth transistor are all PMOS type thin film transistors, and said light-emitting module is organic light-emitting diode.

According to another aspect of the present disclosure, the present disclosure further provides a display device, comprising a display panel, said display panel comprising: a plurality of data lines; a plurality of scanning lines, which are configured in an orthogonally staggered manner with respect to said data lines so as to form a plurality of pixel regions; and a plurality of pixel circuits configured in said pixel regions respectively, wherein each of said pixel circuits comprises: a first transistor, wherein a gate thereof is used for receiving a scanning signal, a source thereof is used for receiving a data signal, and a drain thereof is connected to a first node; a second transistor, wherein a gate thereof is used for receiving said scanning signal, a source thereof is connected to a reference voltage, and a drain thereof is connected to a second node; a storage capacitor connected between said first node and said second node; a third transistor, wherein a gate thereof is connected to said second node, and a source thereof is connected to said first node; a fourth transistor, wherein a gate thereof is used for receiving a signal opposite to said scanning signal, a source thereof is connected to a first voltage, and a drain thereof is connected to said first node; a fifth transistor, wherein a gate thereof is used for receiving a light-emitting signal, and a source thereof is connected to the drain of said third transistor; and a light-emitting module, wherein an anode thereof is connected to the drain of said fifth transistor, and a cathode thereof is connected to a second voltage, said second voltage being lower than said first voltage.

In one embodiment, the display device further comprises: a source driving circuit, connected to said data lines and used for providing data signals; a gate driving circuit, connected to said scanning lines and used for providing scanning signals; a lookup table, stored with different threshold voltages and corrected data voltages corresponding to different gray-scales of each of the threshold voltages; and a data regulator, connected between said lookup table and said source driving circuit and used for adjusting image signals based on corrected data voltages obtained so as to obtain corresponding data signals.

In one embodiment, said first transistor, said second transistor, said third transistor, said fourth transistor, and said fifth transistor are all PMOS type thin film transistors, and said light-emitting module is organic light-emitting diode.

According to another aspect of the present disclosure, the present disclosure further provides a method for compensating threshold voltage for said pixel circuit, said method comprising: providing, in a first interval, a scanning signal to turn off said first transistor and said second transistor, and providing a precharge voltage to precharge a stray capacitor in said pixel circuit; providing, in a second interval, a scanning signal to turn on said first transistor and said second transistor, but turn off said fourth transistor, and detecting, by said stray capacitor and said storage capacitor, a threshold voltage of said third transistor; providing, in a third interval, a scanning signal to turn off said first transistor and said second transistor, outputting the threshold voltage of said third transistor detected by said stray capacitor, and adjusting image signal through searching corrected data voltage corresponding to said threshold voltage; and providing, in said first interval, second interval, and third interval, a light-emitting control signal to turn on said fifth transistor continuously.

In one embodiment, the method further comprises providing, after writing corresponding data signal in said pixel circuit, a light-emitting control signal to turn on said fifth transistor, in order to realize current shunt between said fifth transistor and said light-emitting module.

Compared with the prior art, one embodiment or a plurality of embodiments of the present disclosure may have the following advantages.

The pixel circuit provided by the embodiment of the present disclosure can compensate the threshold voltage of the driving transistor in the pixel circuit through a simple structure. Moreover, since the fourth transistor is arranged, the pixel circuit can not only be used in large sized display device driven through SE mode, but also be used in medium or small sized display device driven through PE mode. That is to say, the pixel circuit has a relatively wide application scope. In addition, since the fifth transistor is arranged, the current flowing through the OLED would not change no matter how the resistance of the OLED increases, and thus the lifetime of the circuit can be prolonged.

Moreover, the threshold voltage compensation method provided by the embodiment of the present disclosure can solve the problems of image spiking and color spots generated by the offset of the threshold voltage, so that the uniformity of the display panel can be improved.

Other features and advantages of the present disclosure will be further explained in the following description, and partially become self-evident therefrom, or be understood through the embodiments of the present disclosure. The objectives and advantages of the present disclosure will be achieved through the structure specifically pointed out in the description, claims, and the accompanying drawings.

BRIEF DESCRIPTION OF THE DRAWINGS

The accompanying drawings are used to provide further understandings of the present disclosure and constitute one part of the description. The drawings are used for interpreting the present disclosure together with the embodiments, not for limiting the present disclosure. In the drawings.

DETAILED DESCRIPTION OF THE EMBODIMENTS

The present disclosure will be illustrated in detail hereinafter in combination with the accompanying drawings to make the purpose, technical solutions, and advantages of the present disclosure more clear.

It should be noted that, in the embodiments of the present disclosure, when a component, such as a substrate, layer, region, thin film, or electrode, is arranged on the "upper" or "lower" side of another component, it can be arranged on the upper or lower side of another component directly, or can be arranged on the upper or lower side of another component indirectly with a spacer component arranged therebetween. In addition, the size and thickness of the components in the accompanying drawings can be enlarged, omitted, or simplified for the purpose of clarity and convenient for explanation. Moreover, the size of the components as shown in the accompanying drawings is not the actual size of the corresponding components.

Figure 1:
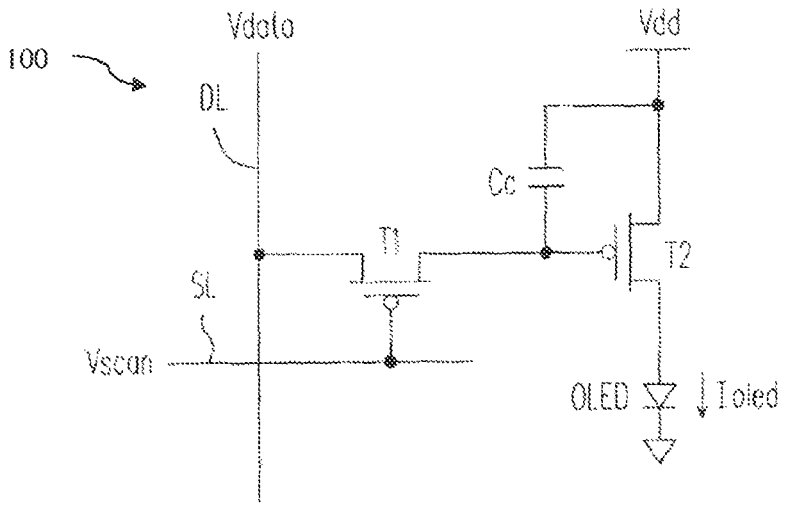
Fig. 1 Prior Art
FIG. 1 is a structural diagram of the pixel circuit in the current OLED display technology.
Figure 2:
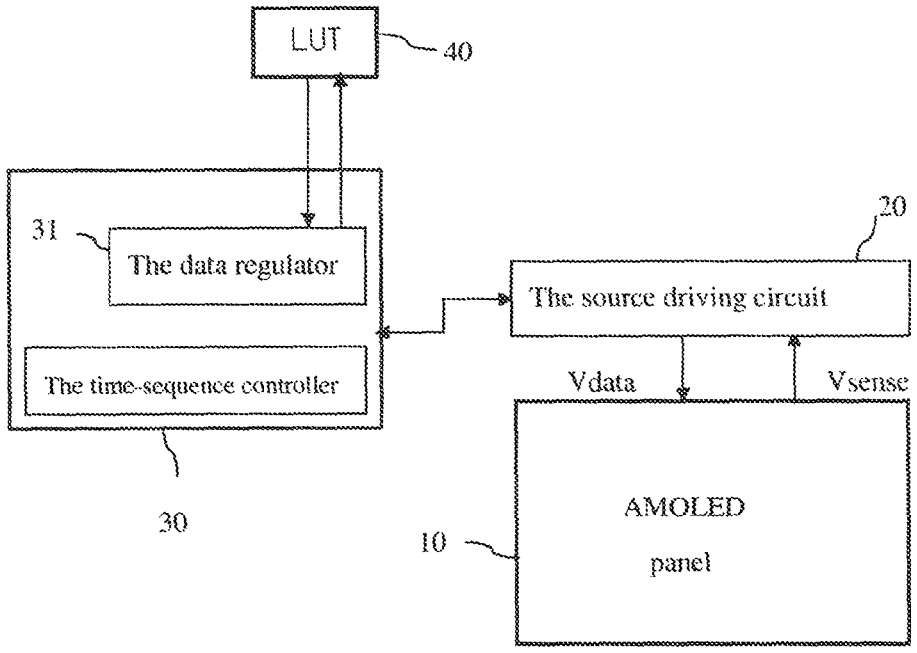
FIG. 2 is a structural diagram of an AMOLED display according to one embodiment of the present disclosure.

FIG. 2 schematically shows a structure of an AMOLED display according to one embodiment of the present disclosure roughly.

As shown in FIG. 2, the AMOLED display comprises an AMOLED panel 10, a time-sequence controller 30, and a source driving circuit 20. In addition, the AMOLED display further comprises a gate driving circuit (not shown in FIG. 2).

The scanning signal, provided by the gate driving circuit, is transmitted to the AMOLED panel 10, and the data voltage Vdata, provided by the source driving circuit 20, is transmitted to the AMOLED panel 10.

Figure 3:
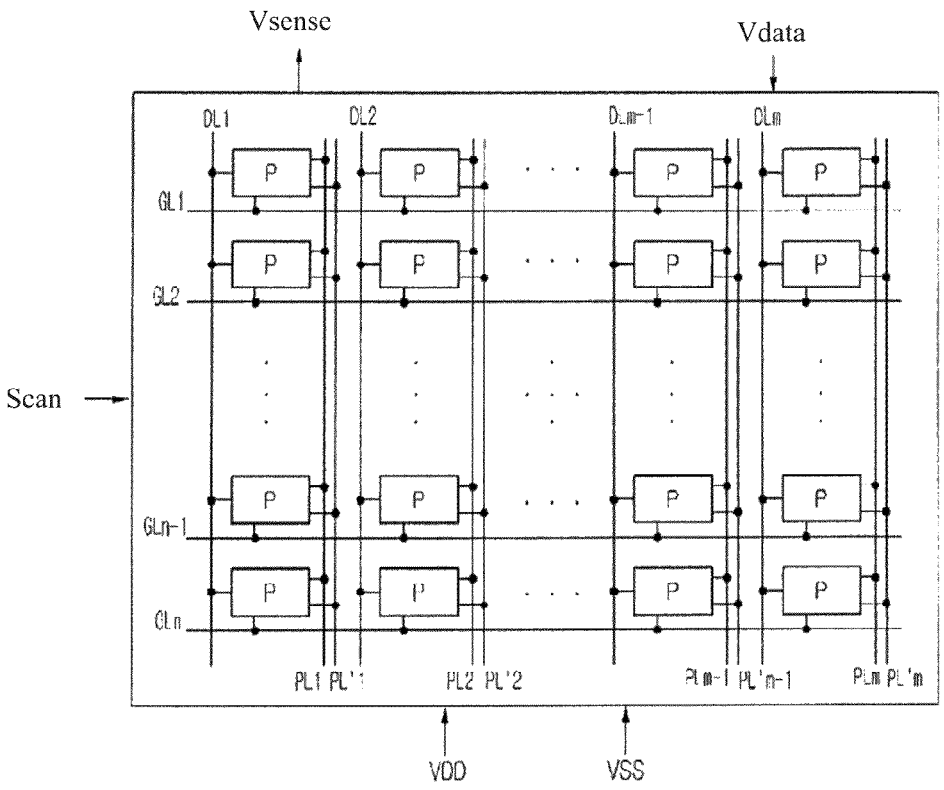
FIG. 3 is a structural diagram of an AMOLED display panel according to one embodiment of the present disclosure.

FIG. 3 is a structural diagram of an AMOLED display panel 10 according to one embodiment of the present disclosure. As shown in FIG. 3, the AMOLED panel 10 comprises a plurality of scanning lines GL1-GLn, a plurality of data lines DL1-DLm, a plurality of first power lines PL1-PLm, and a plurality of second power lines PL'1-PL'm. In addition, the AMOLED panel 10 further comprises a plurality of signal lines (not shown in FIG. 3).

A plurality of pixel regions P, as shown in FIG. 3, are defined by scanning lines GL1-GLn and data lines DL1-DLm that are configured in an orthogonally staggered manner with respect to each other. These pixel regions P can be configured in a matrix. Each pixel region P is connected to a corresponding scanning line, a corresponding data line, a corresponding first power line and a corresponding second power line.

As shown in FIG. 3, each pixel region P receives a scanning signal Scan, a data voltage Vdata, a first power supply voltage (a high system voltage) VDD, and a second power supply voltage (a low system voltage) VSS. Specifically, the scanning signal Scan is provided to the pixel regions P through scanning lines GL1-GLn, and the data voltage Vdata is provided to the pixel regions P through data lines DL1-DLm. At the same time, the high system voltage VDD and the low system voltage VSS are provided to the pixel regions P through the first power lines PL1-PLm and the second power lines PL'1-PL'm respectively.

In addition, a sensing voltage Vsense comprises a threshold voltage Vth of the pixel regions obtained from the pixel regions P. The sensing voltage Vsense is applied to the external parts through the pixel regions P. For example, the sensing voltage Vsense can be applied to the source driving circuit 20 as shown in FIG. 2 through data lines DL1-DLm, or can be applied to a sensing controller which is independent from the source driving circuit 20.

Figure 4:
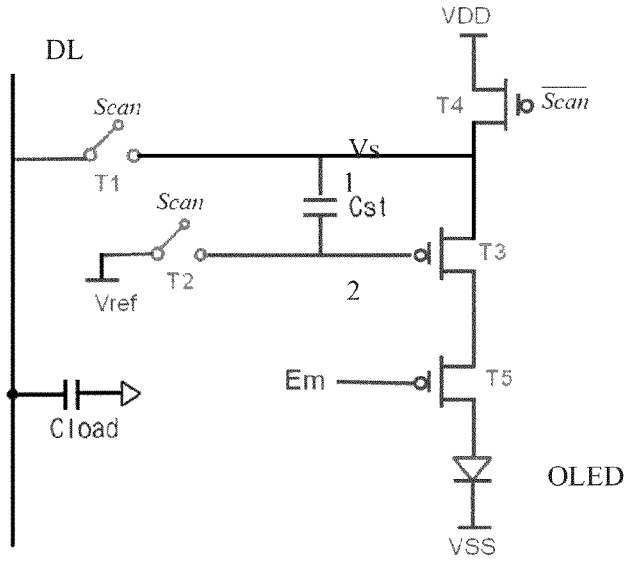
FIG. 4 is a structural diagram of a pixel circuit of an AMOLED display panel according to one embodiment of the present disclosure.

FIG. 4 is a structural diagram of a pixel circuit of an AMOLED display panel according to one embodiment of the present disclosure. As shown in FIG. 4, the pixel circuit of each pixel region P comprises the first transistor to the fifth transistor T1-T5, a storage capacitor Cst, and an Organic Light Emitting Diode (OLED). It should be noted that, the capacitor Cload as shown in FIG. 4 schematically shows the stray capacitor (parasite capacitor) in the circuit.

The first transistor T1 and the second transistor T2 are switching transistors used for transmitting signals. The third transistor T3 is a driving transistor used for generating the driving current to drive the OLED. The fourth transistor T4 is used for turning on or turning off the high system voltage VDD. The fifth transistor T5 is used for reducing the impact of the degradation of the OLED, so as to prolong the lifetime of the pixel circuit.

The storage capacitor Cst is mainly used for keeping the data voltage Vdata unchanged during one frame cycle.

The OLED emits light of different brightness following the variation of the intensity of the driving current. The OLED comprises red OLED which emits red light, green OLED which emits green light, and blue OLED which emits blue light.

The five transistors may be Positive channel Metal Oxide Semiconductor (PMOS) type thin film transistors. The first transistor T1 to the fifth transistor T5 can be turned on by a low-level signal, and turned off by a high-level signal. The high-level voltage may be the ground voltage, or a voltage close to the ground voltage, and the low-level voltage may be a voltage lower than the ground voltage. For example, the low-level voltage and the high-level voltage may be −10V and 0V respectively.

As shown in FIG. 4, the gate of the first transistor T1 is connected to the scanning line GL for applying the scanning signal Scan, the source of the first transistor T1 is connected to the data line DL, and the drain of the first transistor T1 is connected to a first node 1.

The first transistor T1 can be turned on by the scanning signal Scan applied on the scanning line GL, and enables the data voltage Vdata flowing through the data line DL and for displaying the image to charge to the first node 1. The first node 1 is the node connecting the drain of the first transistor T1, one end of the storage capacitor Cst, the source of the third transistor T3, and the drain of the fourth transistor T4.

The gate of the second transistor T2 is connected to the scanning line GL for providing the scanning signal Scan. The source of the second transistor T2 is connected to the reference line for providing a reference voltage Vref. The drain of the second transistor T2 is connected to a second node 2. The second transistor T2 can be turned on by the scanning signal Scan applied on the scanning line GL, and enables the second node 2 to discharge to the reference voltage Vref. The second node 2 connects the drain of the second transistor T2, the other end of the storage capacitor Cst, and the gate of the third transistor T3. The storage capacitor Cst is connected between the first node and the second node. The storage capacitor Cst enables the voltage of the second node 2 to change with the voltage of the first node 1.

The gate of the third transistor T3 is connected to the second node. The source of the third transistor T3 is connected to the drain of the fourth transistor T4.

The third transistor T3 generates the driving current which changes with the voltage of the second node, and applies the driving current on the OLED. The OLED emits light by virtue of the current from the third transistor T3.

The gate of the fourth transistor T4 is connected to the scanning line GL for providing the scanning signal Scan. The source of the fourth transistor T4 is connected to the first power line PL (with the voltage VDD). It should be noted that, in the present embodiment, the fourth transistor T4 receives a reverse scanning signal $\overline{\text{Scan}}$ opposite to the scanning signal Scan; and of course, in other embodiments, the fourth transistor T4 may receive the scanning signal Scan directly.

In the present embodiment, during the process of detecting the threshold voltage of the third transistor T3, the influence of the high system voltage VDD on compensating the threshold voltage can be avoided through turning off the fourth transistor T4 and thus turning off the high system voltage VDD indirectly. Compared with the mode that the high system voltage VDD should be turned off directly during the system compensation process in the prior art, the pixel circuit of the present embodiment can not only be used in the SE driven OLED display device, but also be used in the PE driven OLED display device. The SE driving method means that all pixel regions of the whole panel emit light together after all scanning signals are transmitted, while the PE driving method means that when the scanning signal Scan (N+1) is generated, the pixel corresponding to the scanning signal Scan N starts to emit light.

The on/off states of the driving transistor T3 and the OLED are controlled by the fifth transistor T5. The gate of the fifth transistor T5 is connected to a light-emitting control signal Em, the drain thereof is connected to the anode of the OLED, and the source thereof is connected to the drain of the driving transistor T3. In addition, the cathode of the OLED is connected to the second power line PL' (VSS).

Figure 5:
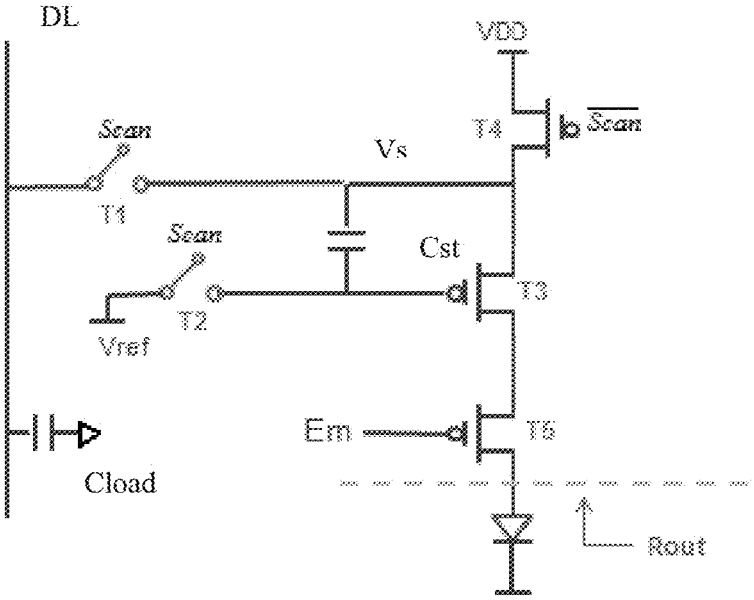
FIG. 5 schematically shows a pixel circuit with normal light-emitting function after data voltage is written according to one embodiment of the present disclosure.

It means that, an output resistance Rout in parallel connection with the OLED is added indirectly to the pixel circuit by providing the fifth transistor T5 (as shown in FIG. 5).

Figure 6:
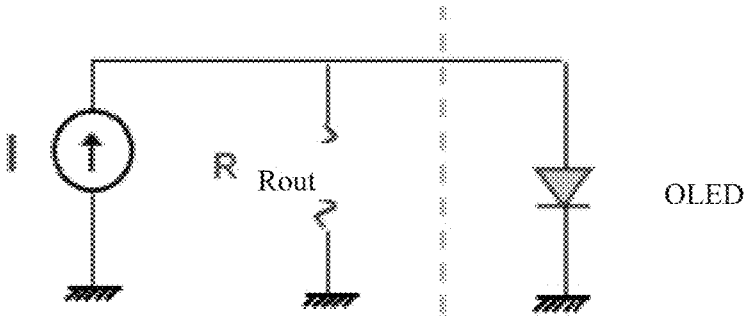
FIG. 6 schematically shows an equivalent circuit of the pixel circuit as shown in FIG. 5.

FIG. 6 schematically shows an equivalent circuit of the pixel circuit with normal light-emitting function after data voltage is written. As shown in FIG. 6, since the output resistance Rout is in parallel connection with the OLED, the current of the OLED is $$I_{OLED} = I \times \frac{Rout}{Rout + R_{OLED}}.$$

Therefore, as long as the output resistance Rout>>$R_{OLED}$, the current flowing through the OLED would not change no matter how the resistance $R_{OLED}$ of the OLED increases. In this manner, the lifetime of the pixel circuit can be prolonged.

Figure 7:
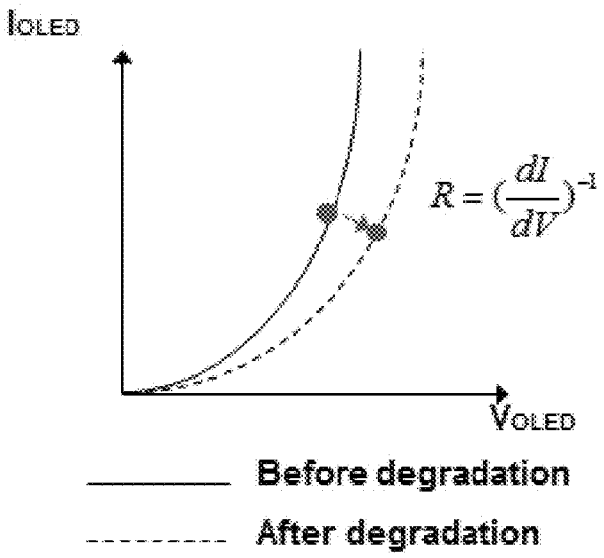
FIG. 7 schematically shows characteristic curves of current and voltage of OLED in an initial state and in a degraded state after long time operation.

As shown in FIG. 7, compared with the initial state, the resistance $R_{OLED}$ of the degraded OLED increases, and thus the current flowing through the OLED will decrease gradually. In the present embodiment, the influence of the degradation of the OLED on the current flowing through the OLED can be reduced, and thus the lifetime of the pixel circuit can be prolonged. It should be noted that, during the process of driving the OLED to emit light, the fifth transistor T5 is turned on each time after the pixel region P is written with the data voltage.

Figure 8:
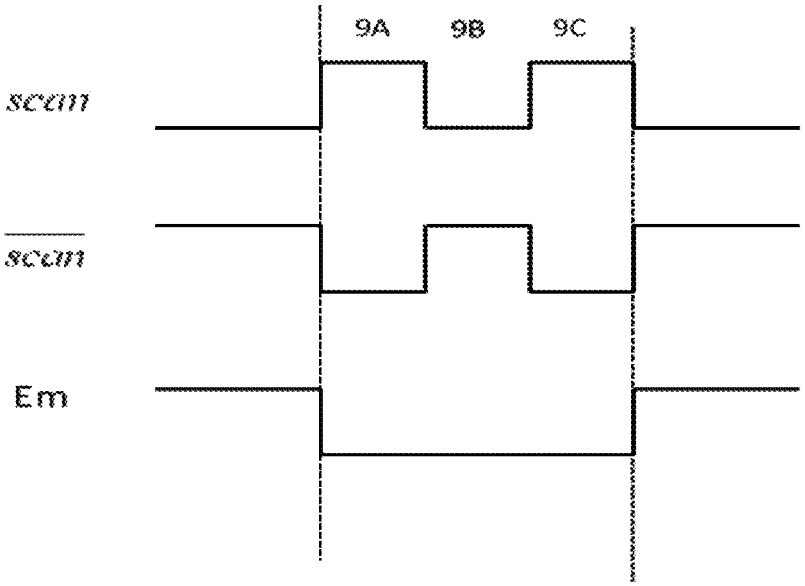
FIG. 8 is a time-sequence diagram when performing system compensation on pixel region P according to one embodiment of the present disclosure.

FIG. 8 is a time-sequence diagram when performing threshold voltage compensation on the pixel circuit in the pixel region P as shown in FIG. 4.

Figure 9A:
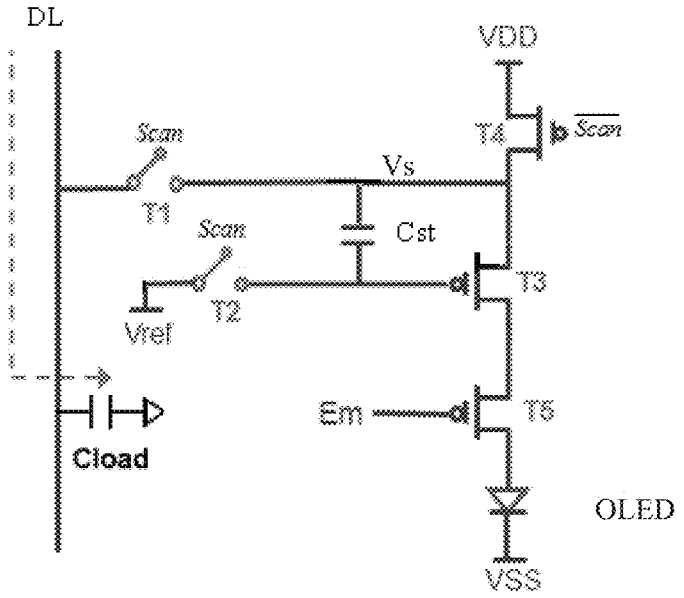
FIG. 9A to FIG. 9C schematically show the on/off state and current flow direction of the pixel circuit as shown in FIG. 4 during different time periods in the system compensation procedure.
Figure 9B:
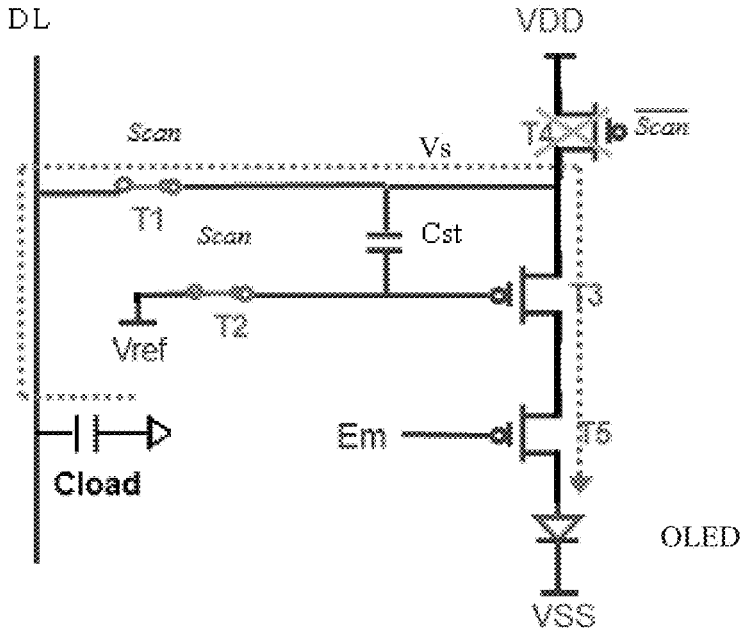
Figure 9C:
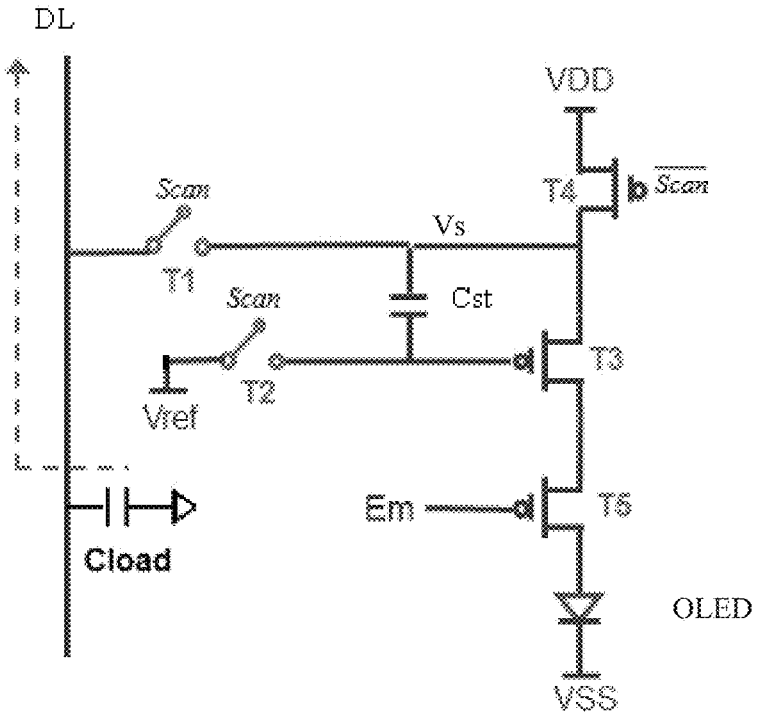

As shown in FIG. 8, in the present embodiment, the compensation on the pixel circuit configured in the pixel region is performed according to three intervals. During the compensation period, the light-emitting control signal Em is in a low-level state continuously, and thus the fifth transistor is turned on continuously. The first interval "9A" as shown in FIG. 8 corresponds to the circuit state as shown in FIG. 9A, the second interval "9B" as shown in FIG. 8 corresponds to the circuit state as shown in FIG. 9B, and the third interval "9C" as shown in FIG. 8 corresponds to the circuit state as shown in FIG. 9C.

In the first interval 9A, a precharge voltage is provided for precharging the stray capacitor Cload existing in the pixel circuit. In the second interval 9B, the threshold voltage Vth of the driving transistor is detected by the stray capacitor Cload and the storage capacitor Cst. In the third interval 9C, the threshold voltage of the driving transistor T3 detected by the stray capacitor Cload is output, and the image signals are adjusted through searching the corrected data voltage corresponding to the current threshold voltage.

The operation of the pixel circuit in the pixel region in the three intervals will be explained in detail respectively with reference to FIG. 8, and FIGS. 9A to 9C.

The First Interval 9A

In the first interval 9A, as shown in FIG. 8, a high-level scanning signal Scan is provided to the scanning line GL, and thus the first transistor T1 and the second transistor T2 are both turned off. In addition, as shown by the dotted line in FIG. 9A, a precharge voltage Vpre is provided for precharging the stray capacitor Cload.

The Second Interval 9B

In the second interval 9B, a low-level scanning signal Scan is provided to the scanning line GL, and thus the first transistor T1 and the second transistor T2 are both turned on. During this period, the scanning signal $\overline{\text{Scan}}$ can opposite to the scanning signal Scan is provided to turn off the fourth transistor T4. And then, the precharge voltage Vpre for precharging the stray capacitor Cload charges to the first node 1 through the first transistor T1, and the reference voltage Vref charges to the second node 2 through the second transistor T2.

In addition, in the second interval 9B, the voltage Vs (i.e., Vpre at this moment) of the first node 1 charges the third transistor T3, until the voltage of the third transistor T3 reaches the threshold voltage Vth. At the moment when the voltage of the third transistor T3 reaches the threshold voltage, the voltage of the first node 1 Vs=Vref+|Vth|. And then, the voltage Vs of the first node 1 charges to the stray capacitor Cload through the first transistor T1. In other words, during this period, the threshold voltage Vth of the third transistor T3 is detected, and finally, the voltage of the stray capacitor Cload is Vcload=Vref+|Vth|.

The Third Interval 9C

During this period, as shown in FIG. 9C, a high-level scanning signal Scan is provided to the scanning line GL, and the first transistor T1 and the second transistor T2 are both turned off due to the high-level scanning signal Scan. The voltage of the stray capacitor Cload is output to the outside system. For example, Vref+|Vth|, as the sensing signal Vsense, is applied on a selector 21 as shown in FIG. 10, and the threshold voltage of the third transistor is extracted by the selector 21.

Figure 10:
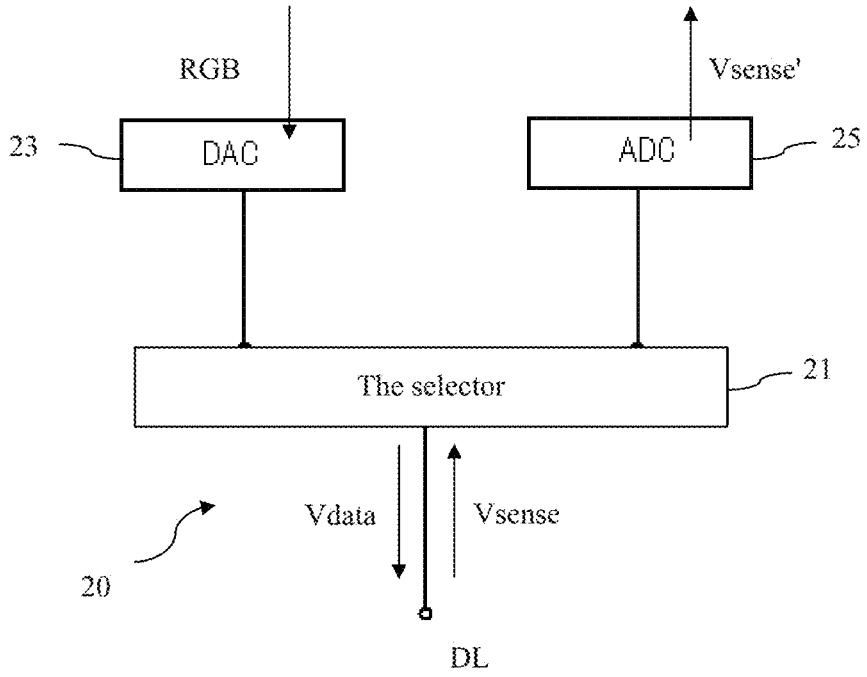
FIG. 10 is a structural diagram of the source driving circuit 20 as shown in FIG. 2.

FIG. 10 is a structural diagram of the source driving circuit 20 as shown in FIG. 2. The source driving circuit 20 comprises the selector 21, a Digital to Analog Converter (DAC) 23, and an Analog to Digital Converter (ADC) 25.

The Digital to Analog Converter 23 can convert the data signals corresponding to color signals R, G, or B into the data voltage Vdata of the analog signals.

The Analog to Digital Converter 25 converts the sensing signal Vsense of the analog data obtained from the pixel region P into the sensing information Vsense' of data signal.

The selector 21 is electrically connected to the Digital to Analog Converter 23 or the Analog to Digital Converter 25 through the data lines DL1-DLm of the AMOLED panel 10.

When the OLED of the pixel region emits light normally, for example, the selector 21 has a low-level voltage in response to a select signal, and is electrically connected to the Digital to Analog Converter 23 through the data lines DL1-DLm. In addition, when the system compensation on the pixel circuit is performed, for example, the selector 21 can have a high-level voltage in response to a select signal, and is electrically connected to the Analog to Digital Converter 25 through the data lines DL1-DLm.

During the third interval 9C, the sensing signal Vsense, as the analog signal, is applied on the selector 21 through the data lines DL1-DLm. In response to the high-level select signal, the selector 21 is electrically connected to the Analog to Digital Converter 25 through the data lines DL1-DLm. In this manner, the analog signal Vsense is applied on the Analog to Digital Converter 25. Further, the analog signal Vsense is converted into the digital signal Vsense' corresponding to the current threshold voltage Vth. The converted digital signal Vsense' is applied on the time-sequence controller 30 as shown in FIG. 2.

As shown in FIG. 2, the time-sequence controller 30 comprises a data regulator 31.

The time-sequence controller 30 receives the digital signal Vsense' corresponding to the threshold voltage, and obtains the corrected voltage value Vdata" under the corresponding gray-scale in the lookup table (LUT) 40 according to the current threshold voltage.

Figure 11:
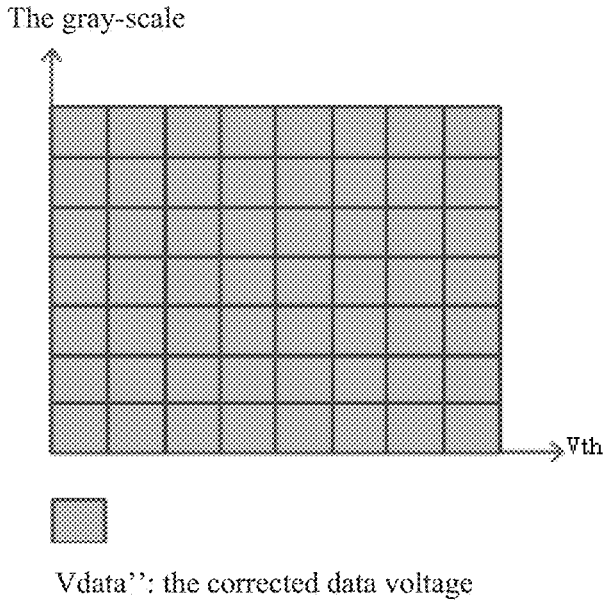
FIG. 11 schematically shows the internal configuration of the lookup table 40 as shown in FIG. 2.

It should be noted that, the lookup table 40 in the present embodiment, as shown in FIG. 11, is stored with different threshold voltages and corrected data voltages corresponding to different gray-scales of each of the threshold voltages, which is different from the prior art. That is to say, the pixel circuit is compensated directly according to the current threshold voltage Vth of the third transistor T3 read back, which is different from the prior art, wherein an offset calculation is performed according to the read back threshold voltage Vth of the driving transistor, and the compensation is performed according to the offset value ΔVth of the threshold voltage obtained therein.

In the prior art, the threshold voltage Vth can be compensated according to the offset value ΔVth, whereby only the problem of image spiking generated by the offset of the threshold voltage Vth can be solved. By contrast, both the problem of image spiking and the problem of color spots in the image generated by the offset of the threshold voltage Vth can be solved by the method of the present embodiment, and thus the display uniformity of the display panel can be improved.

In addition, as a result of the inherent configuration mode of the lookup table, compared with the prior art, neither offset calculator nor offset controller is necessary in the pixel circuit of the present embodiment, and thus the consumption of hardware resources can be reduced.

The data regulator 31 regulates the image signal R'G'B' obtained therein according to the corrected voltage value as obtained.

For example, the corrected data voltage Vdata of a single frame is applied on the data regulator 31. In this manner, the data regulator 31 regulates the first image signal RGB, and outputs the regulated second image signal R'G'B'. And then, the second image signal R'G'B' is applied on the OLED panel 10. Therefore, the non-uniform brightness will not exist in the image after compensation.

Of course, the time-sequence controller 30 is also used for generating other control signals, the details of which are no longer repeated here.

The structure of the pixel circuit of the present embodiment is simple. Since the fourth transistor is arranged, the pixel circuit can not only be used in large sized display device driven through SE mode, but also be used in medium or small sized display device driven through PE mode. That is to say, the pixel circuit has a relatively wide application scope. In addition, since the fifth transistor is arranged, the current flowing through the OLED would not change no matter how the resistance of the OLED increases, and thus the lifetime of the circuit can be prolonged. Moreover, the threshold voltage compensation method provided by the embodiment of the present disclosure can solve the problems of image spiking and color spots generated by the offset of the threshold voltage, so that the display uniformity of the display panel can be improved.

The preferred embodiments of the present disclosure are stated hereinabove, but the protection scope of the present disclosure is not limited by this. Any changes or substitutes readily conceivable for any one skilled in the art within the technical scope disclosed by the present disclosure shall be covered by the protection scope of the present disclosure. Therefore, the protection scope of the present disclosure shall be determined by the scope as defined in the claims.

The invention claimed is:

1. A method for compensating threshold voltage for a pixel circuit, wherein said pixel circuit comprises:

a first transistor, wherein a gate thereof is used for receiving a scanning signal, a source thereof is used for receiving a data signal, and a drain thereof is connected to a first node;

a second transistor, wherein a gate thereof is used for receiving said scanning signal, a source thereof is connected to a reference voltage, and a drain thereof is connected to a second node;

a storage capacitor connected between said first node and said second node;

a third transistor, wherein a gate thereof is connected to said second node, and a source thereof is connected to said first node;

a fourth transistor, wherein a gate thereof is used for receiving a signal opposite to said scanning signal, a source thereof is connected to a first voltage, and a drain thereof is connected to said first node;

a fifth transistor, wherein a gate thereof is used for receiving a light-emitting signal, and a source thereof is connected to the drain of said third transistor; and a light-emitting module, wherein an anode thereof is connected to the drain of said fifth transistor, and a cathode thereof is connected to a second voltage, said second voltage being lower than said first voltage, and wherein said method comprises:

providing, in a first interval, a scanning signal to turn off said first transistor and said second transistor, and providing a precharge voltage to precharge a stray capacitor in said pixel circuit;

providing, in a second interval, a scanning signal to turn on said first transistor and said second transistor, but turn off said fourth transistor, and detecting, by said stray capacitor and said storage capacitor, a threshold voltage of said third transistor;

providing, in a third interval, a scanning signal to turn off said first transistor and said second transistor, outputting the threshold voltage of said third transistor detected by said stray capacitor, and adjusting image signal through searching corrected data voltage corresponding to said threshold voltage; and providing, in said first interval, second interval, and third interval, a light-emitting control signal to turn on said fifth transistor continuously.

2. The method according to claim 1, further comprising:

providing, after writing corresponding data signal in said pixel circuit, a light-emitting control signal to turn on said fifth transistor, in order to realize current shunt between said fifth transistor and said light-emitting module.

3. The method according to claim 1, wherein said first transistor, said second transistor, said third transistor, said fourth transistor, and said fifth transistor are all PMOS type thin film transistors, and said light-emitting module is organic light-emitting diode.

4. The method according to claim 2, wherein said first transistor, said second transistor, said third transistor, said fourth transistor, and said fifth transistor are all PMOS type thin film transistors, and said light-emitting module is organic light-emitting diode.

* * * * *